US007187624B2

(12) United States Patent
Terzian et al.

(10) Patent No.: US 7,187,624 B2
(45) Date of Patent: Mar. 6, 2007

(54) ENHANCED CONTROL BUTTONS FOR DIGITAL TIMEPIECES

(75) Inventors: Berj A. Terzian, Newbury, MA (US); Robert Alfred Brodmann, Weehawken, NJ (US)

(73) Assignee: Equitime, Inc., Newbury, MA (US)

( * ) Notice: Subject to any disclaimer, the term of this patent is extended or adjusted under 35 U.S.C. 154(b) by 236 days.

(21) Appl. No.: 10/948,398

(22) Filed: Sep. 23, 2004

(65) Prior Publication Data

US 2006/0062086 A1 Mar. 23, 2006

(51) Int. Cl.
*G04C 19/00* (2006.01)
*G04B 23/02* (2006.01)

(52) U.S. Cl. ..... 368/69; 368/224; 368/245; 368/82

(58) Field of Classification Search ..... 368/69, 368/70, 72–75, 250, 272–274, 224, 245, 368/82; 342/357.02, 357.03
See application file for complete search history.

(56) References Cited

U.S. PATENT DOCUMENTS 4,250,571 A * 2/1981 Ebihara et al. ..... 368/10
4,368,989 A * 1/1983 Kawashima ..... 368/74
4,483,230 A * 11/1984 Yamauchi ..... 84/603
5,119,346 A * 6/1992 Henderson et al. ..... 368/109
5,343,446 A * 8/1994 Simmons et al. ..... 368/251
6,236,622 B1 * 5/2001 Blackman ..... 368/10
2004/0070602 A1 * 4/2004 Kobuya et al. ..... 345/738

OTHER PUBLICATIONS

RM313PA :: donrowe.com/oregon_scientific/rm313pa.html; Aug. 18, 2001.*
Projection Alarm Clock with Highlo.tm. Backlight Model : RM313PNA: Oregon Scientific; Copyright 2005.*

* cited by examiner

*Primary Examiner*—Vit Miska
*Assistant Examiner*—Sean Kayes
(74) *Attorney, Agent, or Firm*—Lucas & Mercanti, LLP

(57) ABSTRACT

Enhanced control buttons are provided for a digital timepiece, each button marked with an icon which identifies its function, one icon indicative of the so marked button being operable to turn a night light on/off, another icon indicative of the so marked button being operable to access and exit from a real time setting mode, another icon indicative of the so marked button being operable to access and exit from an alarm time setting mode, said alarm button being programmable to operate in response to momentary and relatively longer pressures to perform a variety of alarm time functions, including turning on and off a similar alarm icon in the timepiece's display, turning off the alarm sound after it becomes audible following a set alarm time, and thereafter turning on the alarm icon in the watch display for repetition of the sounding of the alarm 24 hours later at the same previously set alarm time.

4 Claims, 2 Drawing Sheets

ENHANCED CONTROL BUTTONS FOR DIGITAL TIMEPIECES

BACKGROUND OF THE INVENTION

1. Field of the Invention

This invention relates to digital watches, clocks and similar timepieces that are traditionally operated with multiple control buttons. More particularly, the invention provides a new system of enhanced control buttons that alleviates or eliminates much of the difficulties that have been experienced in operating timepieces having conventional control buttons.

2. Description of the Prior Art

Conventional digital timepieces, e.g. wrist watches, are generally provided with multiple control buttons located around, and in some cases atop, the watch case. These buttons are usually operated by pressing them into the case to perform control functions such as illuminating the time display at night, accessing setting modes for real and alarm times, retrieving calendar dates, other stored information or messages, etc. The buttons are sometimes identified by word names in adjacent locations, or some or all of the buttons are not named, so that written operating instructions have to be consulted to perform the corresponding functions. Many users have complained about the complexity and difficulty of operating digital timepieces with such conventional control buttons.

Other types of prior art digital timepieces are characterized as operating in non-traditional display modes, such as quadribalanced, balanced, enhanced quadribalanced and unidirectional segmented. These systems are disclosed in several issued patents, for example, U.S. Pat. Nos. 4,271,497, 4,627,737, 6,215,736 and 6,584,041, the disclosures of which are incorporated herein by reference.

These timepieces were designed to operate with a single setting crown, instead of buttons, thereby eliminating many of the problems of conventional control buttons. In addition to omission of buttons, the single setting crown embodied the functional principle of singularity. That is to say, forward and reverse twists of the crown in the case, and similar twists with the crown pulled axially out of the case, provided four singular operating positions each of which could be used to perform a single, or single type of, function which could be easily learned, remembered and performed without having to consult written instructions.

For example, in one design, repeated forward twists with the crown in the case would turn the night light on and off. Repeated reverse twists would activate and deactivate the alarm time setting mode, as well as the alarm sound when it would become audible at the set time. Pulling the crown out of the case without preactivation would immediately enter the real time setting mode, and with preactivation into the alarm setting mode. Thereafter, repeated reverse twists would select and flash each real time, alarm time and calendar functions, while repeated forward twists would advance the values of each such function to the desired value. U.S. Pat. No. 4,720,823 discloses such a crown, the disclosure of which is incorporated herein by reference.

The new system of control buttons provided by the present invention achieves the advantage of singularity for each button, like the single setting crown described above. This is especially important for the single button that is devoted to preactivating the alarm setting mode, entering such mode to set the alarm time, then returning to real time and terminating the alarm sound when it becomes audible at the set alarm time.

SUMMARY OF THE INVENTION

The invention is based on the realization that control buttons for digital timepieces can be constructed with integral icons that render them immediately recognizable and intuitive as to the functions they each perform. Moreover, such buttons are preferably located on the top face of the timepiece, below the time display, in a predetermined arrangement, such that the different modes of them that are typically most often accessed are readily available for operation by a user's forefinger. In addition, two buttons are located on the right side of the case in a predetermined arrangement that permits selection, flashing and advancing the values of each function, again with the forefinger. Preferably, the left side of the case is purposely made without any buttons to enable a user to press on it with his thumb while operating either the select or set buttons, thus applying squeezing pressure on the case and buttons without risk of inadvertent interference from or with any other button during the selection and setting process. These attributes of the control buttons of the invention allow a user to operate all functions of a wrist watch without having to remove it from his wrist.

Finally, one of the top buttons is programmable to operate with both a momentary and a relatively longer time of pressure to render it capable of performing all of the functions of accessing and exiting an alarm setting mode, and repeatedly turning off and restoring the alarm function as often as a user may desire.

Other features and advantages of the invention will be understood by reference to the following description of a preferred embodiment thereof, as illustrated in the drawings.

Figure 1:
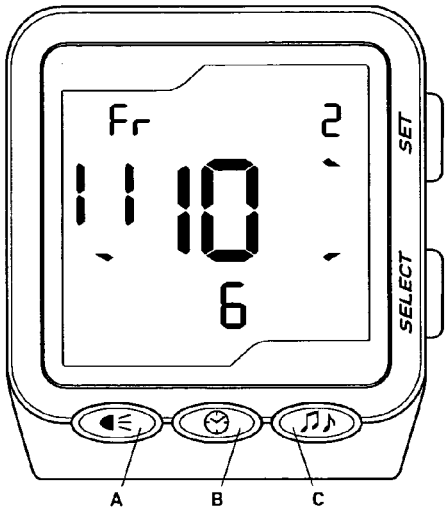
FIG. 1 is a plan view of a wrist watch case that includes three icon marked buttons in a row below the time display and two vertically spaced buttons on the right side of the case.

Referring now to FIG. 1, it illustrates a generally square watch face and case displaying the real time of 11 minutes and 6 seconds to 10, on a Friday dated the second. This is an example of enhanced quadribalanced time, as taught in U.S. Pat. No. 6,215,736. Below the time display is a horizontal row of three buttons marked with icons. Button A depicts a light source and rays of light. Button B depicts an analog watch face with hour and minute hands. Button C depicts a melody of three eighth note tones, which preferably is the specific melody described in co-pending application Ser. No. 10/756,485, filed Jan. 12, 2004.

Button A is programmable to turn on an electro-luminescent light for illuminating the time display in the dark. Preferably the program permits the user to press and hold the button for as long as he or she wishes the light to remain on, and after release to automatically become extinguished. Alternatively, and preferably, a momentary press of the button will turn the light on which will automatically self-extinguish after a set period of time, e.g. approximately 5 seconds, in order to conserve battery life.

Button B is programmable to switch the display into a real time setting mode after being momentarily pressed by the user. Thereafter, all real time and calendar functions are incrementally selected and flashed by pressing the SELECT button, and the values of each advanced to a desired value by pressing the SET button, for example, in the order of seconds, minutes, hours, AM/PM, day name, month, day and year dates. At any time during or at the end of such sequence, another momentary press of button B will return the display to real time.

Figure 2:
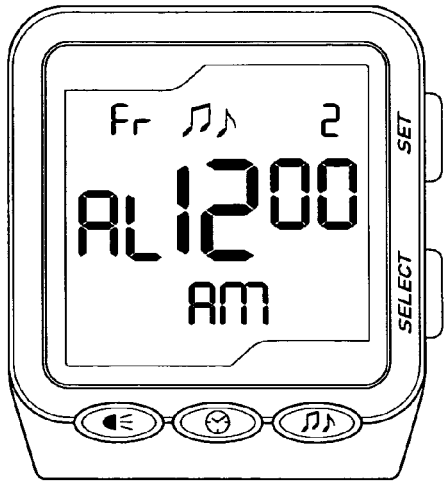
FIG. 2 is a plan view after the watch has entered the alarm setting mode.

Button C is programmable to operate in response to two types of pressure applied by the user. A momentary press of preferably about 1 to 1½ seconds will turn the melody icon on in the top of the time display, as illustrated in FIG. 2. A relatively longer pressure of preferably approximately 3 to 5 seconds will turn on the melody icon and also switch the time display into the alarm setting mode. This is depicted in FIG. 2 where the display includes an "AL" prompt (for alarm) on the left side, hour 12 and zero minutes on the right, and "AM" beneath the hour. This identifies the fact that the alarm time is midnight which has been programmed into the watch as the default start up time when the alarm mode is initiated for the first time. Thereafter, the desired alarm time is set by selecting, flashing and advancing the values of minutes, hours and AM/PM, preferably in that order, by alternate operation of the SELECT and SET buttons for each of these functions, in a similar manner to the real time setting process previously described above. After the alarm time has been set, a momentary press of button C will switch the display back to the real time display.

Figure 3:
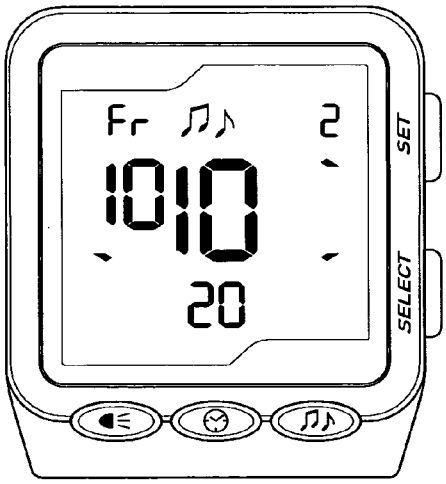
FIG. 3 is a plan view after an alarm time has been set and the display has returned to a subsequent real time.

This is illustrated in FIG. 3 where the display has returned to 10 minutes and 20 seconds to hour 10, demonstrating that the down counting of 6 to zero seconds in FIG. 1 and the down counting of 40 more seconds in FIG. 3 has resulted in a total period of 46 elapsed seconds within which the user accessed the alarm setting mode, set a chosen alarm time and then returned to the real time display of FIG. 3.

As shown in the latter, the melody icon remains on in the top of the display. This reminds the user that the melody or alarm will sound when the set alarm time is reached. At that time, a momentary press of button C will both terminate the sound and also turn off the icon. If desired the same alarm time can be re-activated to sound 24 hours later by another momentary press of button C, after a delay of preferably 30 to 60 seconds to permit the current sounding time to self-extinguish. Finally, the user can check the previously set alarm time at any moment by applying the relatively long pressure time on button C to enable seeing that time in the display, and thereafter pressing button C momentarily to return to the real time display, as previously described for the process of switching the display from FIG. 1 to FIG. 2 to FIG. 3.

Figure 4:
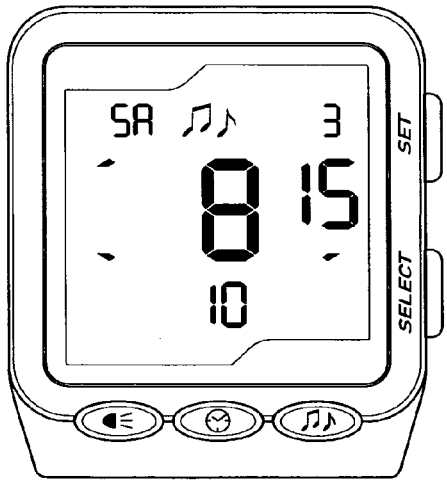
FIG. 4 is a plan view after the alarm has sounded and several seconds later.
Figure 5:
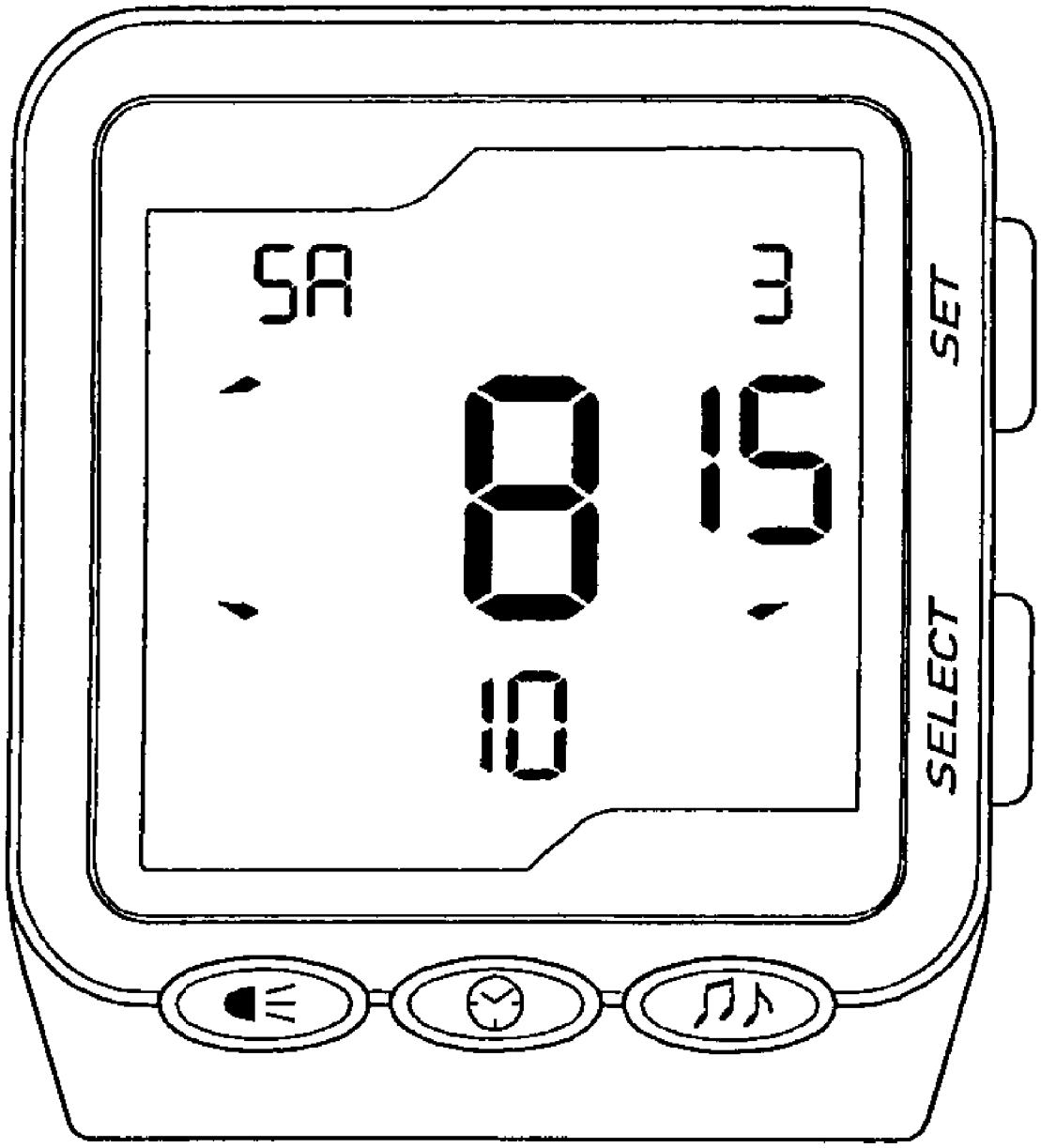
FIG. 5 is a plan veiw after the alarm sound has been extinguished by the user.

FIG. 4 is demonstrative of a typical setting of an alarm time when the alarm setting mode illustrated in FIG. 2 is accessed on Friday the $2^{nd}$ On the next day, Saturday the $3^{rd}$, the alarm has sounded at the set time of 8:15 a.m. and has been allowed to sound for 10 seconds by the user. Thereafter, it and the melody icon would be turned .off by momentarily pressing button C, which will leave the then current real time on the display. This is illustrated in FIG. 5 where the melody icon has been deactivated and blanked in the display.

Buttons A, B and C are preferably oval-shaped and slighted raised above the horizontal surface plane of the watch face to enhance their ergonomic contact with the user s forefinger. The icons may be embossed or engraved into the button surfaces and, in the latter case, optionally filled with ilks or dyes to heighten their contrast and visibility from the remainder of the button surfaces. The SELECT and SET indicia are preferably printed on the watch surface beside their corresponding buttons on the right side of the case, as illustrated in the drawings. The left side of the case is purposely left without buttons, so that the user can readily hold that side with his or her thumb and thereby stabilize the watch against motion to the left as the SELECT and SET buttons are pressed in that direction in a squeezing manner. These latter buttons are programmable to advance the values of functions singly by momentary presses, and continuously in approximately ½ second increments by pressing and holding the buttons down for as long as a user desires.

The invention has been described in terms of its general principles and a preferred specific embodiment. Many variations and modifications of such embodiment will be obvious to those skilled in the art. It should be understood that all such variations and embodiments are intended to be covered by the following claims and all equivalents thereof.

The following is claimed:

1. Enhanced control buttons for a digital timepiece comprising a wrist watch, a set of three buttons provided on the wrist watch, each button marked with an icon which identifies the function performed by it, one icon being a light source and light rays indicative of the fact that the so marked button will turn on and off a night light, another icon being an analog watch with hour and minute hands indicative of the fact that the so marked button will access and exit from a mode for setting real time, and another icon being a musical melody indicative of the fact that so marked button will access and exit from a mode for setting an alarm time, said three buttons being located in a horizontal row across the top surface of the watch below its display, two other buttons located in vertically spaced positions in the right side of the watch case, one of the two being identified by an adjacent word SELECT and the other by an adjacent word SET indicative of the fact that the SELECT button is programmable to select and flash values of a selected function and the SET button is programmable to advance the values of a selected function to a desired value.

2. A wrist watch according to claim 1 wherein the melody button is programmable to operate:

(a) in response to momentary pressures:

(1) to turn on and off a similar melody icon in the watch display, and to turn off the sound of the melody and the melody icon after the melody becomes audible following a set alarm time, and to turn on the melody icon for repetition of the sounding of the melody 24 hours later at the same previously set time; and (b) in response to relatively longer pressures:

(2) to turn on the similar melody icon in the watch display as well as initiate access to the mode for setting an alarm time.

3. A wrist watch according to claim 1 which is without buttons on the left side of the watch case.

4. A wrist watch according to claim 1 wherein the wrist watch exhibits a balanced, quadribalanced, enhanced quadribalanced or unidirectional segmented time display.

* * * * *